US008057317B2

(12) United States Patent
Roodenburg et al.

(10) Patent No.: US 8,057,317 B2
(45) Date of Patent: Nov. 15, 2011

(54) AMUSEMENT PARK ATTRACTION

(75) Inventors: Joop Roodenburg, Delfi (NL); Johan Willem Philippen, Schinveld (NL); Olaf Karl-Heinz Mordelt, Jagsihausen (DE)

(73) Assignees: Vekoma Rides Engineering B V, Vlodrop (NL); Olaf Karl-Heinz Mordelt, Jagsthausen (DE)

( * ) Notice: Subject to any disclaimer, the term of this patent is extended or adjusted under 35 U.S.C. 154(b) by 651 days.

(21) Appl. No.: 11/667,071

(22) PCT Filed: Nov. 5, 2004

(86) PCT No.: PCT/NL2004/000780

§ 371 (c)(1),
(2), (4) Date: Jul. 25, 2007

(87) PCT Pub. No.: WO2006/049484

PCT Pub. Date: May 11, 2006

(65) Prior Publication Data

US 2007/0265103 A1 Nov. 15, 2007

(51) Int. Cl.
*A63B 67/00* (2006.01)

(52) U.S. Cl. ..... 472/43; 472/44

(58) Field of Classification Search ..... 472/43, 472/44; 463/52

See application file for complete search history.

(56) References Cited

U.S. PATENT DOCUMENTS

| | | | | |
|---|---|---|---|---|
| 4,821,845 | A * | 4/1989 | DeViaris | 187/245 |
| 5,403,238 | A | 4/1995 | Baxter et al. | |
| 5,615,992 | A * | 4/1997 | Proske et al. | 414/807 |
| 5,628,690 | A * | 5/1997 | Spieldiener et al. | 472/131 |
| 5,845,434 | A * | 12/1998 | Hayashi | 52/9 |
| 5,964,666 | A | 10/1999 | Uemura et al. | |
| 6,551,108 | B1 | 4/2003 | Weinspach et al. | |
| 6,592,463 | B1 | 7/2003 | Gnezdilov et al. | |
| 6,626,126 | B1 * | 9/2003 | Kalve | 114/368 |
| 6,871,596 | B2 | 3/2005 | De-Gol et al. | |
| 2002/0068640 | A1 * | 6/2002 | Uemura et al. | 472/60 |
| 2002/0183123 | A1 * | 12/2002 | De-Gol | 472/59 |
| 2004/0192453 | A1 * | 9/2004 | Esparza et al. | 472/44 |
| 2004/0265096 | A1 * | 12/2004 | James | 414/234 |

* cited by examiner

FOREIGN PATENT DOCUMENTS

| | | | |
|---|---|---|---|
| DE | 91 12 009 | U1 | 1/1993 |
| DE | 199 00 528 | A1 | 9/2000 |
| FR | 2 643 626 | A | 8/1990 |

*Primary Examiner* — Alvin Hunter
*Assistant Examiner* — Michael Dennis
(74) *Attorney, Agent, or Firm* — Birch, Stewart, Kolasch & Birch, LLP

(57) ABSTRACT

An amusement park attraction comprises an array of cells, the array including cells being arranged at various horizontal positions and various vertical positions. A movable passenger assembly, preferably a seat assembly, is provided for one or more passengers, which passenger assembly is at least movable in vertical direction. The passenger assembly and/or the array of cells is movable in horizontal direction.

Figure 1:
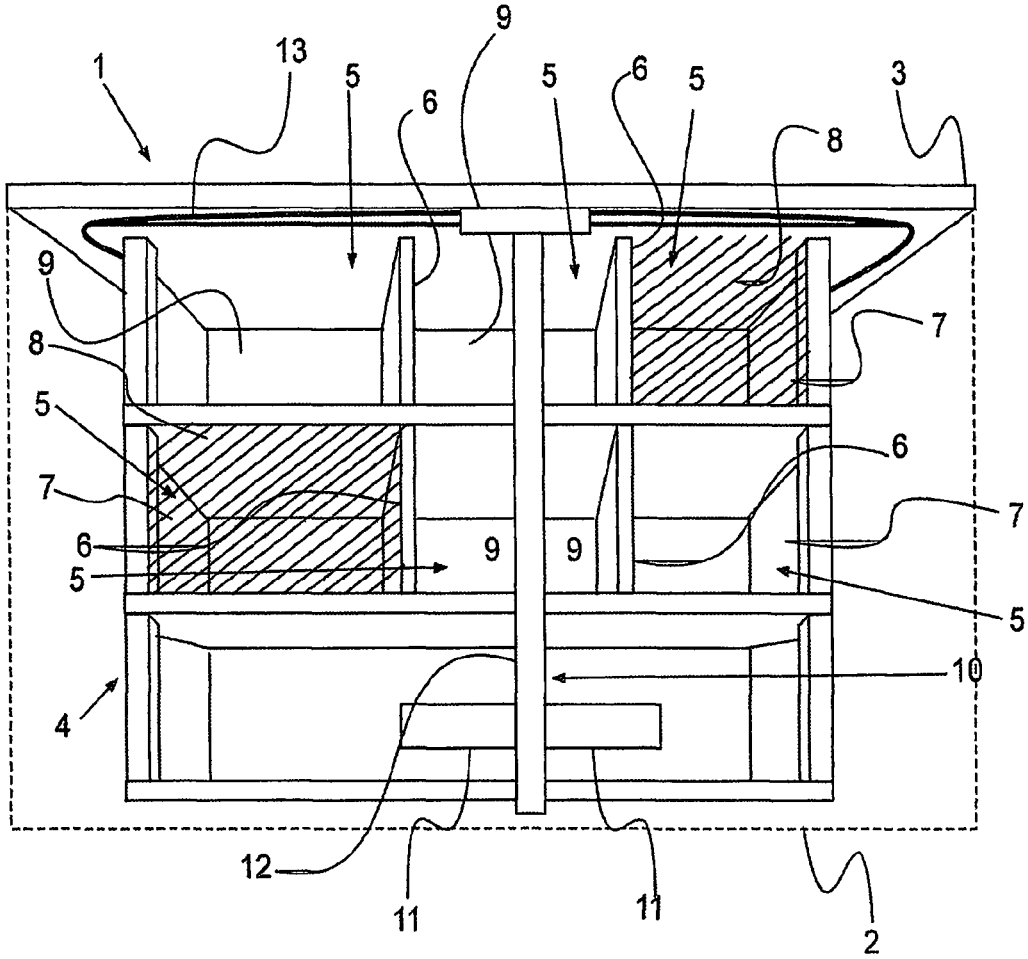

A cell is defined by a boundary and has a viewing opening. Mmultiple cells of said array each contain a discrete scene to be viewed by the one or more passengers.

A programmable actuating system is provided, which actuating system provides a programmed route of said passenger assembly along the viewing openings of said scene containing cells, so that the one or more passengers are presented a predetermined sequence of scenes and at least experience a vertical motion along said route.

Preferably the passenger assembly is movable in vertical direction and at least in one other direction, preferably multiple other directions, said other directions preferably including at least one rotational direction, if desired a composite motion in multiple directions simultaneously.

Preferably the array of cells is stationary and the actuating system is associated with said passenger assembly to impart motions at least in vertical as well as horizontal direction to said passenger assembly.

59 Claims, 14 Drawing Sheets

AMUSEMENT PARK ATTRACTION

The present invention relates to an amusement park attraction. In a known attraction a carriage in which one or more persons can be transported follows a path through a continuous extending scenery.

The invention aims at providing an alternative amusement park attraction.

This is achieved by an amusement park attraction according to claim 1. The persons in the passenger assembly have a view through the viewing opening on the scene in a cell as were it a show-box.

The attraction is configured to have cells at multiple height levels, which not only allows for an attractive experience when the passenger assembly is displaced from one height to another but also allows for a configuration of the attraction which requires a relatively limited area in the attraction park.

The array can have more cells than required for a particular sequence of scenes, "a story", so that some cells will remain empty and can be closed at the viewing opening side if desired.

It is envisaged that a park can change the "story" of the attraction by providing new scenes in suitable cells in the array of cells and by reprogramming the route of the passenger assembly. This eliminates the need to significantly change the passenger assembly and actuating system as well when a park desires to provide a new "story" to the public with said attraction.

It can also be envisaged that multiple parks, e.g. in different countries, have an attraction according to the present invention with arrays or at least cells of similar dimensions. In this manner it will be possible to exchange "stories" from one park to another by basically exchanging the scenes and reprogramming the actuating apparatus of each attraction. Of course it might be necessary to alter the passenger assembly and the motion apparatus wherein it is received as well, if this does not entirely suit the story, but the costs will be far less than when converting prior art amusement park attractions.

In a preferred embodiment one or more scenes comprise animated objects. These animated objects can be physical objects, e.g. animated puppets or vehicles.

A scene can also comprise projected images e.g. projected on a surface. Also a combination of animated physical as projected images is possible.

Preferably the passenger assembly is moveable in connection with a displayed scene so as to also give a motive sensation to the passengers. The assembly is e.g. moveable in a trembling manner when in the scene a vehicle is approaching at high speed. The public in the assembly not only sees and hears the approaching vehicle, but then also feels it. Another example is that the assembly is performing a rocking movement when the scene depicts a boat on water, e.g. in a storm.

Preferably the assembly is adapted to perform highly accelerated and/or decelerated translational and/or rotational movements. This could be a movement downwards in a free fall or approximating a free fall, when e.g. the scene shows a puppet that cuts a cord of an elevator. The movement could also be an upward launch movement, e.g. when a rocket launch, explosion, or hit by a vehicle is simulated. Also, if desired in combination with another movement, the passenger assembly could be rotated such that the passengers turn up side down, e.g. so as to intensify the perception of the hit.

Preferably the passenger assembly is movable in vertical direction and at least in one other direction, preferably multiple other directions, said other directions preferably including at least one rotational direction, if desired a composite motion in multiple directions simultaneously. In a preferred embodiment the passenger assembly is capable of six degrees of freedom. A particular "story" might not require the need to use all degrees of freedom provided by the passenger assembly.

In a preferred embodiment the array of cells is stationary and the actuating system is associated with said passenger assembly to impart motions at least in vertical as well as horizontal direction to said passenger assembly.

In another embodiment the array of cells is movable in horizontal direction and the passenger assembly is movable in vertical direction while stationary in horizontal direction. It can also be envisaged that the passenger assembly has a limited motion range in horizontal direction in order to subject the passengers to the sensation of motion in horizontal direction, whereas the array is also movable in horizontal direction, e.g. rotating about a vertical axis.

In a preferred embodiment the actuating system includes at least one carriage, said carriage having a frame adapted to follow an associated carriage path, which carriage path extends along the array of cells, and each carriage further having a passenger assembly movable with respect to the frame.

Preferably the carriage path extends essentially in a horizontal plane, and the array includes cells being arranged at various horizontal positions along said carriage path including cells being arranged at various vertical positions with respect to said carriage path, and the passenger assembly is movable in at least vertical direction with respect to the frame. By providing the carriage path in a horizontal plane the drive means for propelling the one or more carriages along the path can be kept simple, as no vertical movement of the carriages takes place. This is in particular relevant when the weight of a carriage is great. The present invention envisages carriages each weighing more than 2000 kg in unloaded state, even up to about 10.000 kg per carriage.

In a practical embodiment the carriage path is formed by a track, e.g. one or more rails upon which the carriage engages, possibly the track comprising an upper and a lower rail along which an upper and a lower end of the carriage are respectively guided.

In a preferred embodiment a storage facility is provided for storing at least one carriage remote from the carriage path while said carriage is not in use. This allows adapting the capacity of the attraction as well as performing maintenance on the carriages while the attraction is in use.

In a possible embodiment the array of cells comprises a matrix arrangement of cells next to one another and above one another. Such a matrix allows for an efficient use of floor space for the attraction.

Possibly the matrix arrangement of cells is embodied as an essentially flat faced block of cells having viewing openings at one side or both side of the block of cells.

As an alternative the matrix arrangement of cells is embodied as an at least partly curved faced block of cells, possibly a circular or annular block of cells, having viewing openings at one or both sides of the block of cells.

Preferably the array of cells is formed as a structure, so that each cell has a ceiling, floor, side walls and a rear wall, that form the cell boundary of the respective cells. A curtain, a net, a piece of fabric, foil, etc could also provide the boundary.

In a possible embodiment the structure forms a multi-story building with preferably rectangular cells, although also differently shaped cells are of course possible. The cells can all have the same dimensions, but it is also possible that one or more of the cells have different dimensions as the other cells.

This enables to create differently sized scenes, e.g. scenes with a great height to simulate a free fall or the like, e.g. along a waterfall, rock cliff.

In a possible arrangement the carriage is moveable in a looped path around the array of cells. Possible said array has cells with viewing openings in different, e.g. opposed directions.

In a possible embodiment the attraction comprises more than one scenery structure, wherein the carriage is moveable along and between the scenery structures, such that all cells of the structures are reachable by the passenger assembly.

It is preferred that the passenger assembly is movable at least 3 meters, preferably at least 6 meters, and more preferably at least 10 meters in vertical direction. This allows for attractive vertical motions as well as stacking of multiple cells in height.

Preferably the actuating system is adapted to provide an acceleration and/or deceleration of the passenger assembly in vertical direction, in downwards and/or upwards direction, of at least 0.3 G, preferably at least 0.5 G, more preferably at least 0.7 G, preferably to simulate or provide a free-fall experience and/or upwards launch movement.

It is preferred that the passenger assembly comprises restraining means for the passengers, e.g. adapted to restrain each individual passenger.

In a particular attractive embodiment the passenger assembly is adapted for rotation of the one or more passengers between a "head-up" and a "head-down" orientation.

In a possible embodiment a cell has air blow means for providing special effects related to the scene in the cell concerned. This could be air blow means that blow e.g. warm air when an explosion or a fire is simulated in the scene or e.g. cold air when a polar scene is simulated. Also moist air could be ejected by the air blow means that relates to a wet scene. Other possibilities are to create a pressure wave with the air blow means when e.g. simulating an explosion. Also wind effects can be created with the air blow means.

In a further embodiment it is possible to add a smell to the air such that the public has an even more realistic perception of a scene. One could think of e.g. a smell of gunpowder when the scene relates to an explosion or a shoot out.

Preferably an outer darkening structure is enclosing the array of cells and the path of the one or more carriages. By darkening the attraction special effects have a better effect as is known per se.

The invention also relates to a motion apparatus, preferably embodied as a carriage, for an amusement park attraction.

In a known amusement park attraction carriage a passenger seating area is provided which is connected to a chassis movable along a track. An actuating system imparts motion to the seating area along a plurality of axes independent of any motion of the chassis as it moves along the track. These carriages are used for example in dark rides, passing various sceneries.

It is an object of the invention to provide an alternative motion apparatus, which can be embodied as carriage.

The invention achieves this object by providing a motion apparatus according to claim 25.

With the inventive motion apparatus a more attractive motive experience can be achieved. The passenger in the seat can be subjected to an unexpected movement in relation with a scene. Small bumps in a road can be simulated, but thanks to the vertically extending frame allowing a vertical translational movement also a sensation of an elevator or a free-fall can be simulated.

Furthermore, with a carriage according to the invention a passenger seated in the seat assembly can pass multiple sceneries arranged above each other without need for an ascending or descending path for the carriage itself.

In a preferred embodiment, the frame of the carriage according to the invention is a single vertical upright.

Preferably the frame allows for a vertical motion of said passenger assembly of at least 3 meters, preferably at least 5 meters, more preferably at least 10 meters, possibly at least 20 meters.

Also, in particular in combinations with preferred accelerations and/or decelerations cited above, a spectacular sensation, such as of a fast moving elevator or of a free-fall can be achieved.

It will be clear that with a passenger assembly movable over a large vertical distance multiple sceneries on top of each other can be reached.

Preferably, the path along which the frame of the carriage moves is formed by a track. The track preferably comprises one or more rails, preferably at both the upper and the lower end of the frame. This will enhance the stability of the frame.

In a preferred embodiment, the motion apparatus further comprises a slide, to which the seat assembly is connected, which slide is movable along the frame. Such a slide facilitates the vertical translation movement of the seat assembly. Preferably, guide rails are provided on the frame along which the slide is movable. Possibly, bearings are provided between the slide and the frame.

Preferably, the slide is arranged coaxial with the upright. This is particularly beneficial when a column-shaped upright is used, around which a hollow cylindrical slide can be arranged. In another embodiment, for example when a metal framework tower or with a square cross section is used as a frame, slides can travel in a vertical translation movement along one or more of the sides of the upright. A coaxial arrangement of the slide allows multiple non-interacting seat assemblies connected via the one or more slides to the frame.

In a preferred embodiment, the carriage is provided with a hoisting device for moving the seat assembly upwardly and downwardly in a vertical translation movement. Preferably, the hoisting device comprises at least one hoisting wire, connected to a winch assembly and to the seat assembly. Possibly the hoisting wire is guided along one or more pulleys.

In another, more expensive embodiment, the vertical translation movement of the seat assembly is achieved by the application of electromagnetic drive means.

It is also possible to use electromagnetic means to decelerate the movement of the seat assembly, also in combination with a hoisting device.

In a further preferred embodiment, the carriage is provided with rotation drive means so as to allow a rotational movement of the seat assembly with respect to the frame around a rotation axis extending parallel to the longitudinal axis of the frame. This allows a turning movement of the seat assembly around the vertical upright, for example to turn away from the scenery. A rotational movement of the seat assembly can for example be achieved arranging the slide rotatable with respect to the upright. This is particularly beneficial when the slide can translate in a vertical direction without the additional need of guide rails. With adequate drive means, both a translational and a rotational movement of the slide can be achieved.

In another preferred embodiment a socket is connected to the slide, which socket is rotatable with respect to the upright. The slide can move over the vertical guide rails, while the socket is driven by the rotation drive means, for example a slew gear, to rotate with respect to the slide. Preferably, the rotation drive means are arranged between the slide and the socket. Preferably the socket is arranged coaxial with the slide. Possibly, one or more bearings are provided between the socket and the slide.

A further preferred embodiment of the carriage according to the invention comprises an arm, which extends radially from the frame and bears the seat assembly. A benefit of providing said arm between the seat assembly and the frame is that this allows a seat assembly provided with multiple seats arranged in a row, extending in a radial direction from the upright. This allows multiple visitors to be arranged in front of the same scenery, and experiencing the same movements of the seat assembly. Also, all seats can move away from the scenery simultaneously.

Also, a further degree of freedom of movement of the seat assembly can be achieved by providing the radially extending arm between the seat assembly and the frame. For example, the seat assembly could be connected slidably to the arm, making additional horizontal translations possible. In particular, multiple movements can be achieved by providing the arm with one or more hinges. When the arm is connected with one end to the socket and with the other end to the seat assembly, the seat assembly can move vertically by means of the slide and rotate around the frame by means of the socket. In addition to these movements, the seat assembly can for example tilt or rotate around an axis arranged in the central area of the seat assembly by means of hinges arranged on the arm. The hinges will divide the arm in multiple parts. In the case of one hinge, the arm will be divided in an inner arm part connected to the frame and an outer arm part connected to the seat assembly.

In an embodiment of the arm of the entertainment carriage a first hinge has a substantially vertical hinge axis. The vertical hinge axis allows a swinging motion of the seat assembly in a horizontal plane.

In an embodiment in which the first hinge is located at an end of the arm close to the frame the rotational movement of the arm with the seat assembly can enhance the effect of the rotational movement of the socket around the frame. For example, a sensation of being catapulted backwards can thus be created. Also, such a first hinge can be arranged on a slide, without the arrangement of a socket.

In another embodiment the first hinge is located at an end of the arm close to the seat assembly. This allows a rotational movement of the seat assembly around its center, which can be particular beneficial if multiple seats are arranged in the seat assembly, for example to move all seats fast away from the scenery.

An embodiment is possible comprising multiple first hinges at various places of the arm.

In a further preferred embodiment of the arm, a second hinge is provided with a substantially horizontal hinge axis extending radially from the frame. The seat assembly can tilt forwardly or backwardly around this axis, for example creating a sensation of being 'tipped over'. For example, said second hinge is arranged in the central area of the arm, dividing the arm in an inner arm section attached to the frame and an outer arm section attached to the assembly.

In a more preferred embodiment, the seat assembly can rotate clockwise and anti-clockwise around a third horizontally extending hinge axis which is perpendicular to the longitudinal axis of the arm and perpendicular to the longitudinal axis of the upright. Preferably, this third hinge axis is located at the end of the arm connected to the seat assembly in the central area of the seat assembly. Upon rotation, one end of the seat assembly will move upwards, while the other end will move downward. For example, by a high frequency sequence of rotational movement over a small angle a sensation of trembling can be created in the seats.

The present invention also relates to an amusement park attraction including a motion apparatus of the present invention.

The present invention also relates to a method for operating an amusement park attraction according to the present invention.

The present invention also also relates to a method for operating an amusement park attraction according to the present invention, including the steps of:

drafting a story containing a sequence of discrete scenes, associating to one or more of said scenes motive effects to be experienced by the one or more passengers, allocating each of the discrete scenes to a suitable cell in the array of cells, programming the actuating system in order to effect the route along the scenes and any desired motive effect to be experienced by the one or more passengers.

The present invention also relates to a method of converting an amusement park attraction according to the invention from an existing story to a new story, including the steps of:

drafting a new story containing a sequence of discrete scenes, associating to one or more of said new scenes motive effects to be experienced by the one or more passengers, allocating each of the discrete scenes to a suitable cell in the array of cells, removing one or more scenes relating to the existing story from the cells, reprogramming the actuating system in order to effect the route along the new scenes and any desired motive effect to be experienced by the one or more passengers.

The motion apparatus provided by the present invention can also be arranged stationary in an amusement park, e.g. as an alternative (free-fall) tower which provides not only a vertical motion but also one or more other motions to the passengers.

Figure 2A:
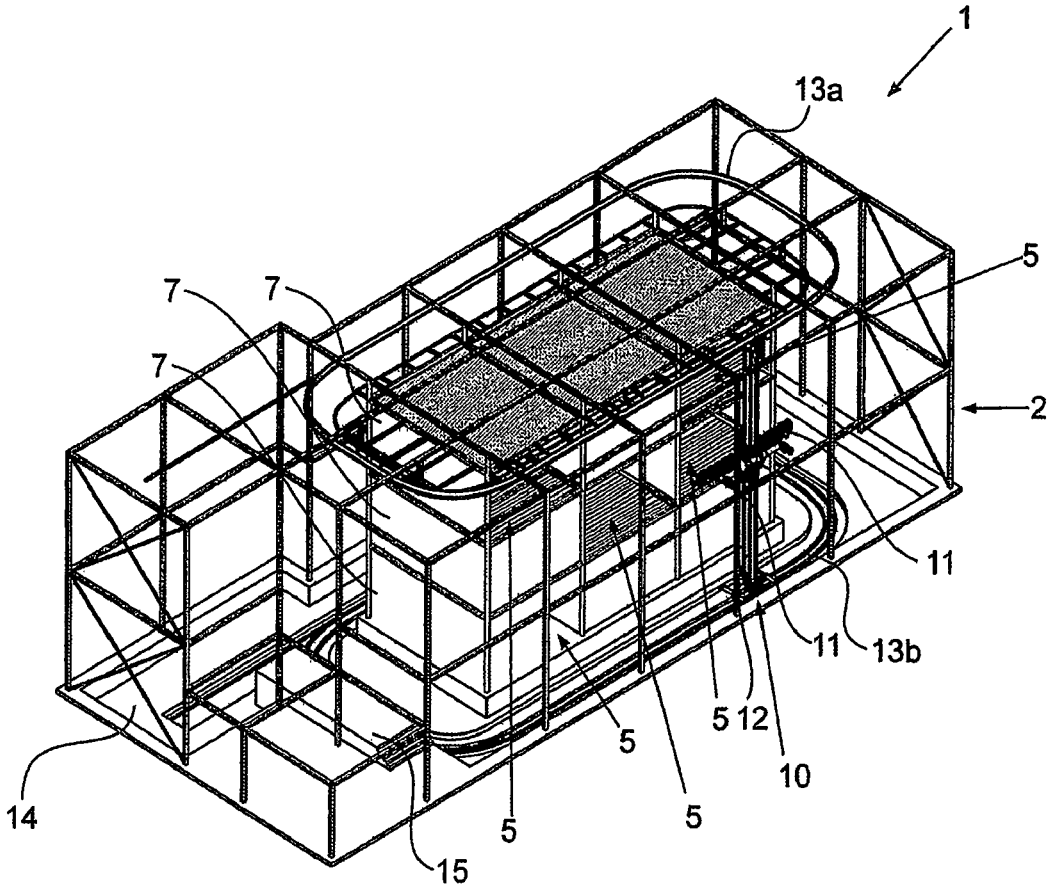
Figure 2B:
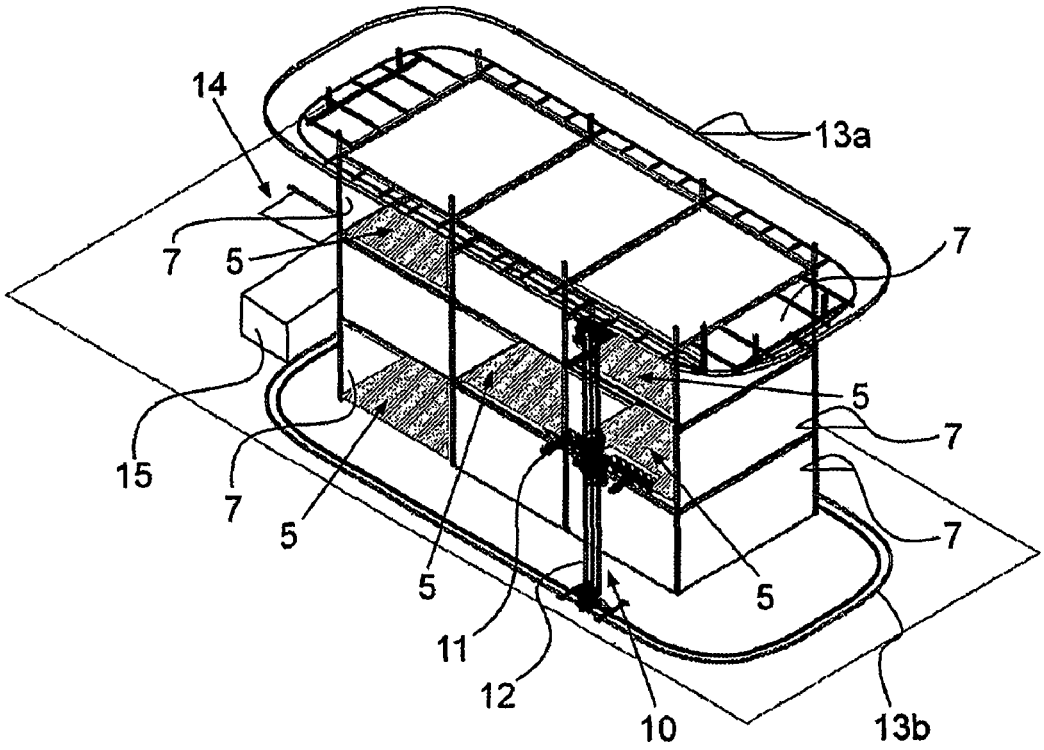
Figure 3A:
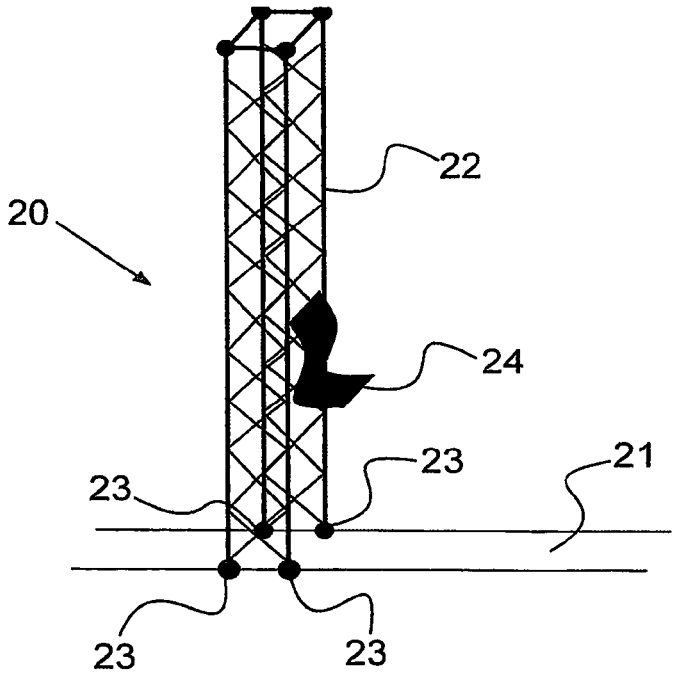
Figure 3B:
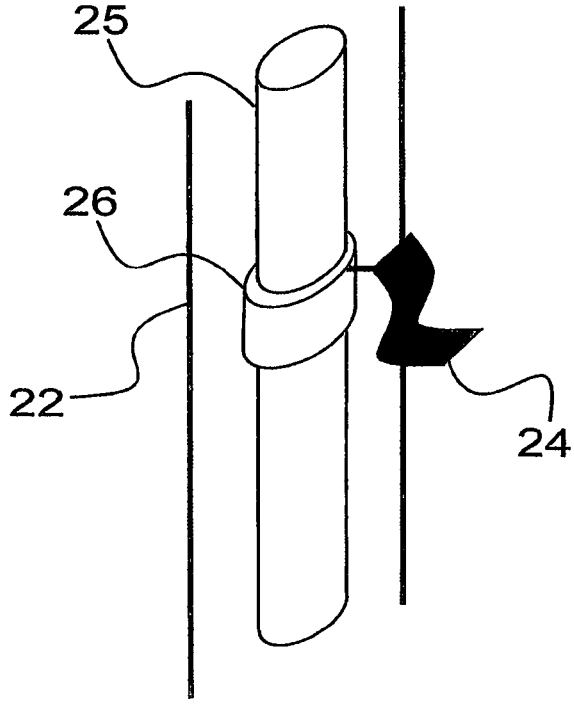
Figure 4:
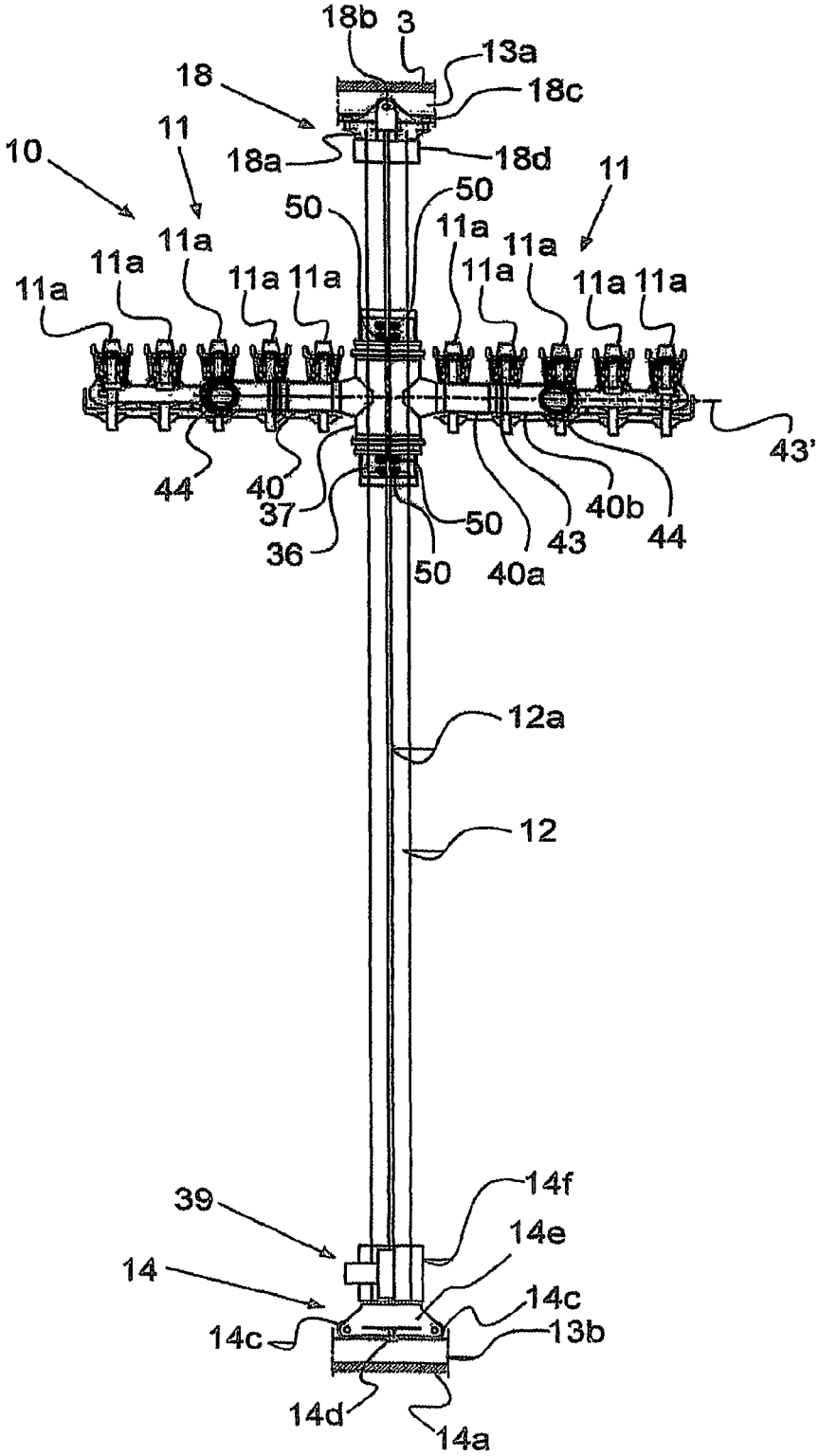
Figure 5:
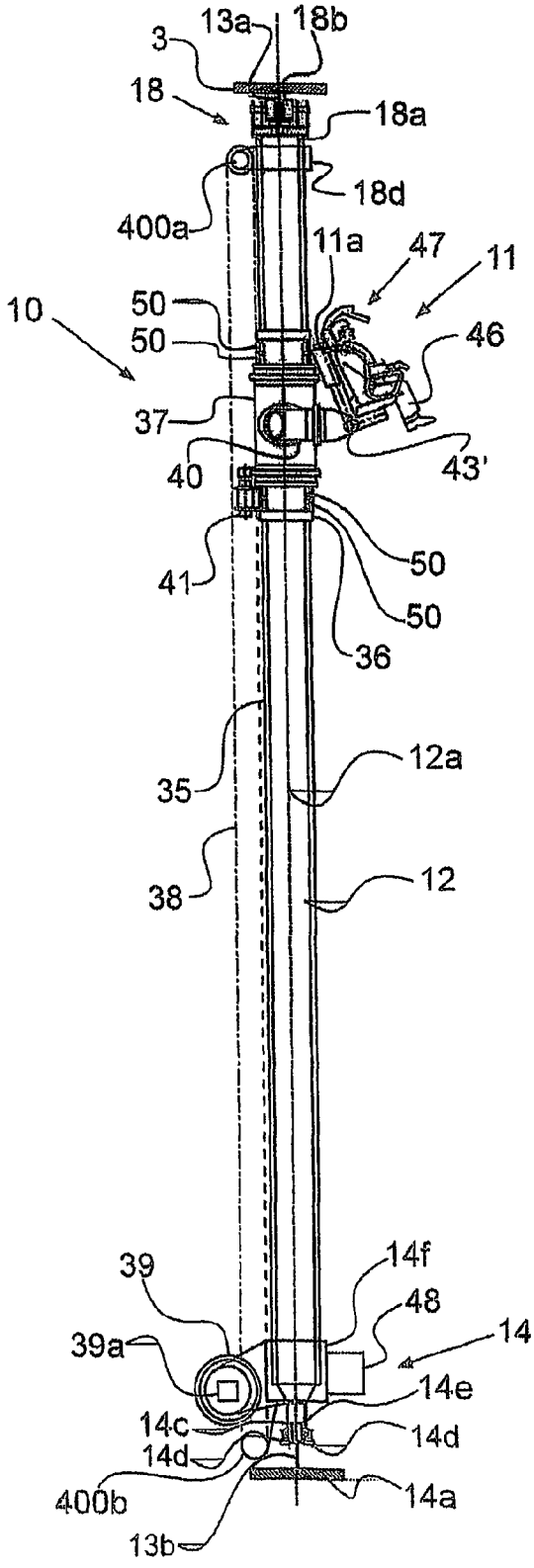
Figure 6A:
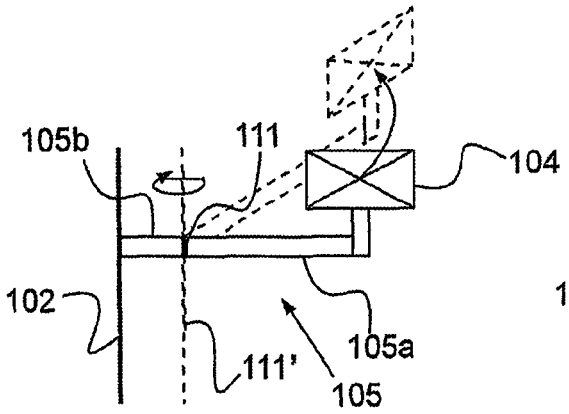
Figure 6B:
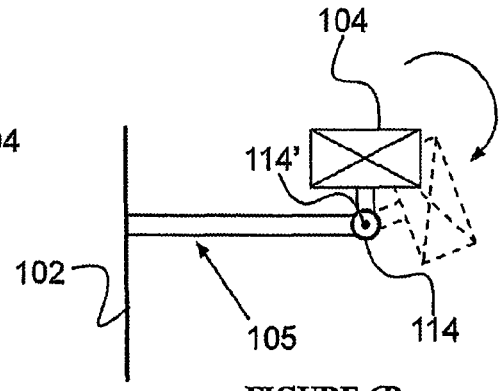
Figure 6C:
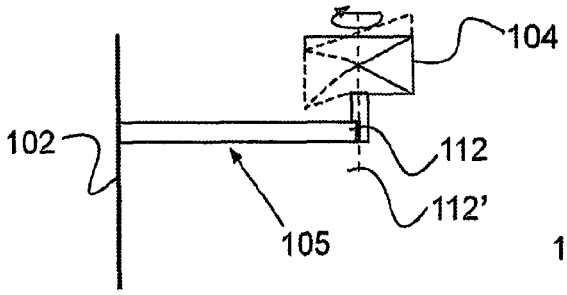
Figure 6D:
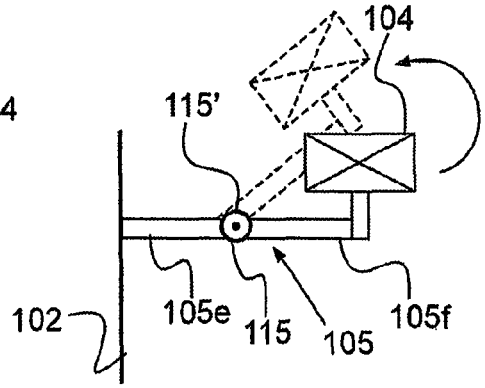
Figure 6E:
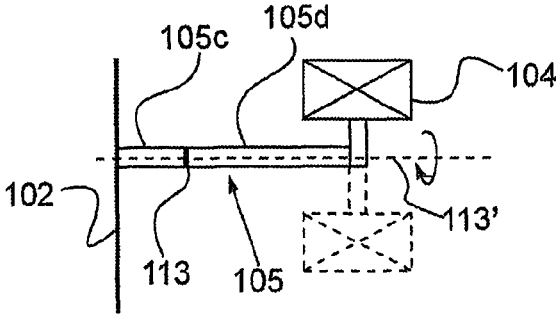
Figure 7:
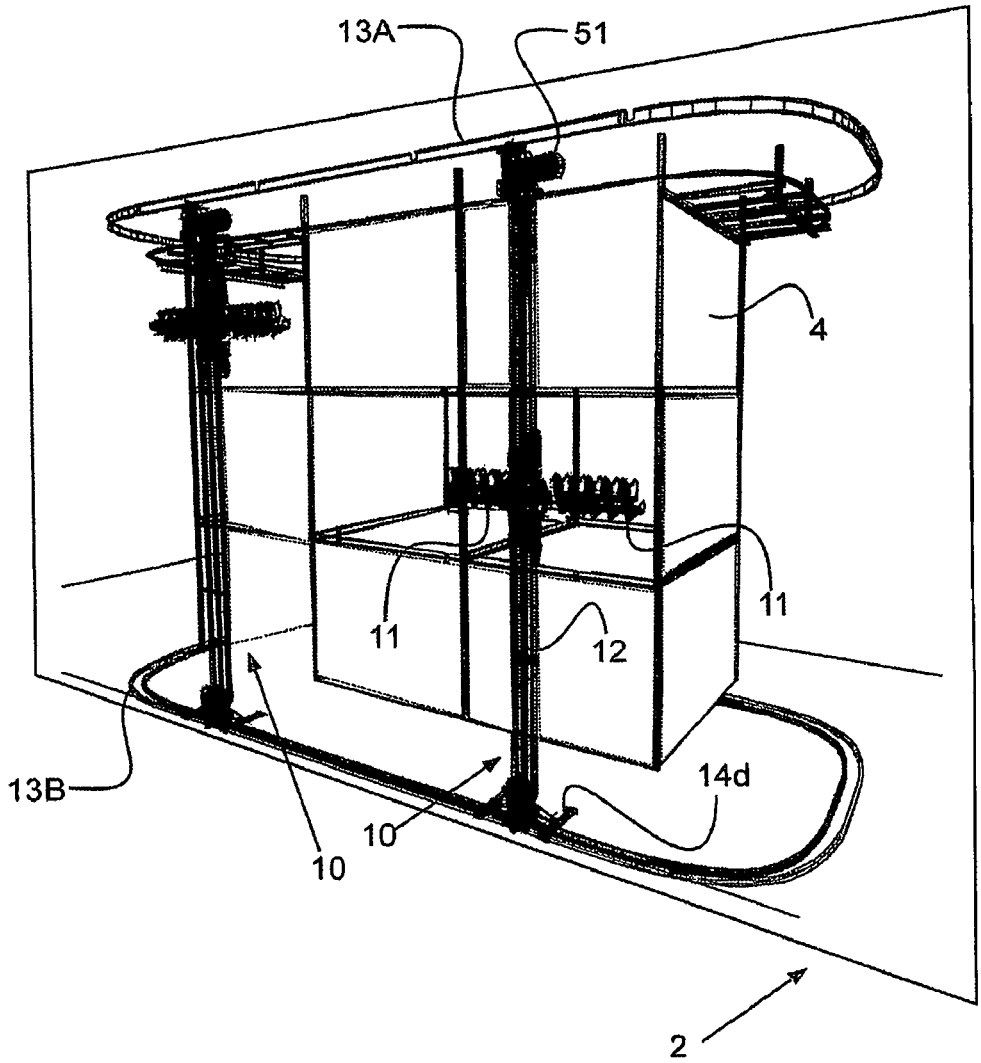

The invention will be illustrated in more detail in the following description with reference to the drawing, in which FIG. 1 shows an front view of an exemplary embodiment of an amusement park attraction according to the invention, FIG. 2*a* shows a cut-away view of a preferred embodiment of the amusement park attraction with an darkening structure framework, FIG. 2*b* shows the amusement park attraction of FIG. 2*a* without said framework, FIGS. 3*a* and 3*b* show a schematic view of a carriage according to the invention, FIG. 4 shows front view of a preferred embodiment of a carriage according to the invention, FIG. 5 shows a side elevational view of the carriage of FIG. 4, FIGS. 6*a*-6*e* show schematically various hinges in an arm extending radially from a frame to a seat assembly, FIG. 7 shows another perspective view of the preferred embodiment of FIG. 2, FIGS. 8*a,b* show a further embodiment of a carriage according to the present invention, FIG. 9*a* a detail of the back of the carriage of FIGS. 8*a,b,*

Figure 8A:
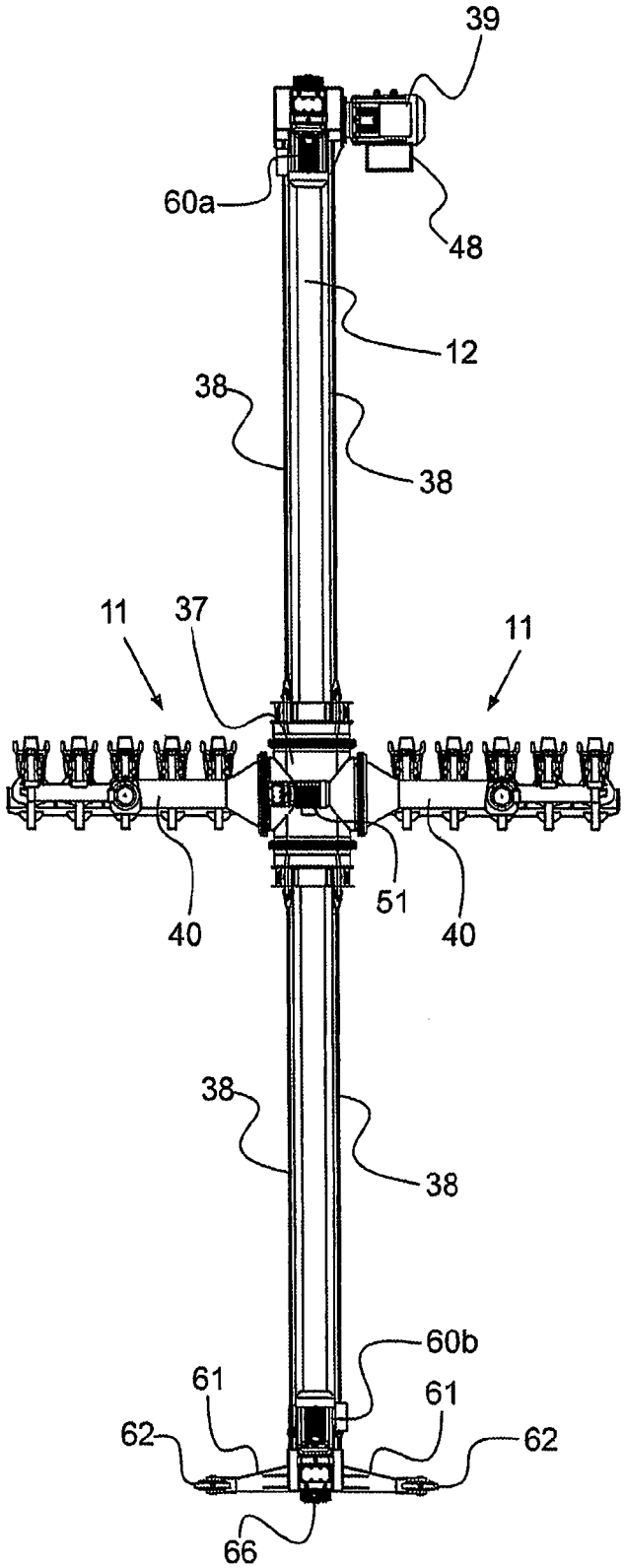
Figure 9A:
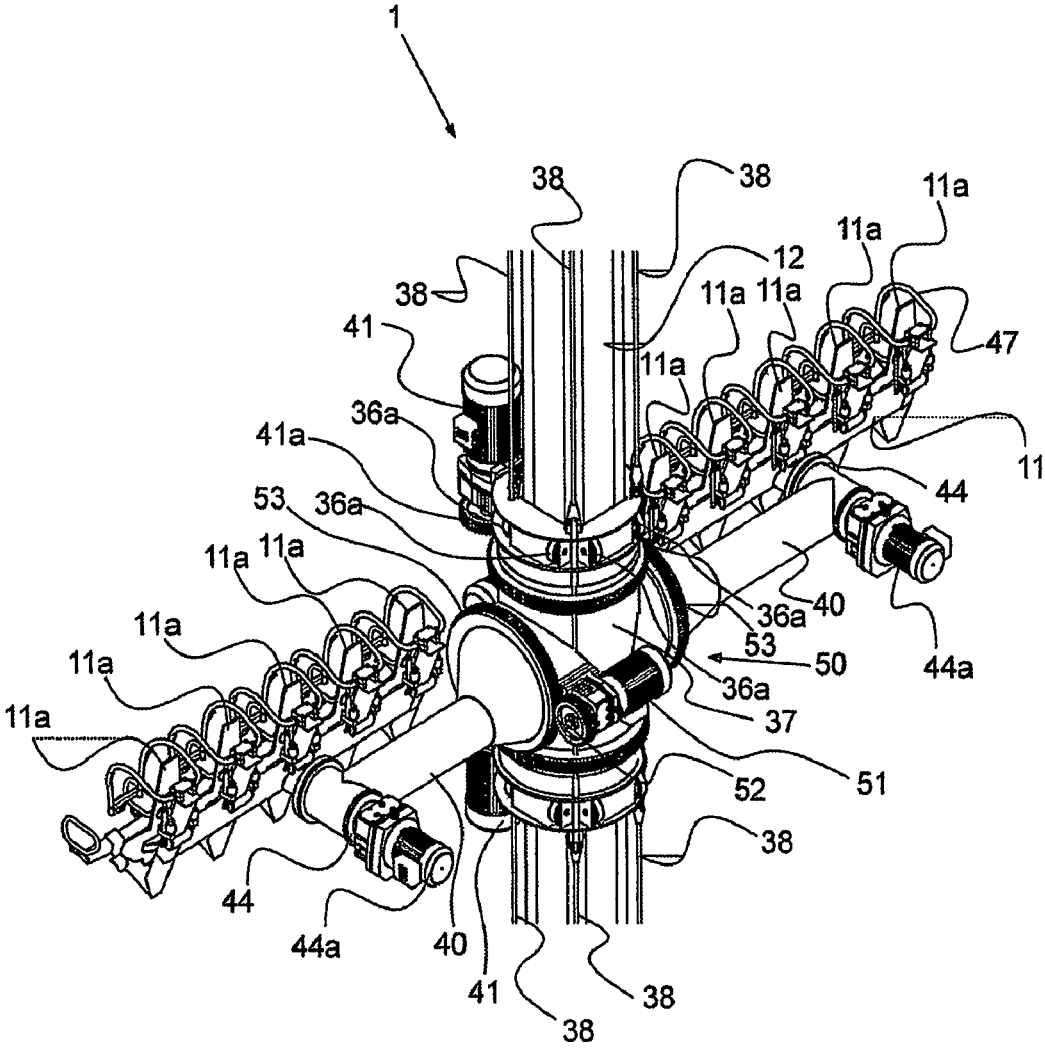
Figure 9B:
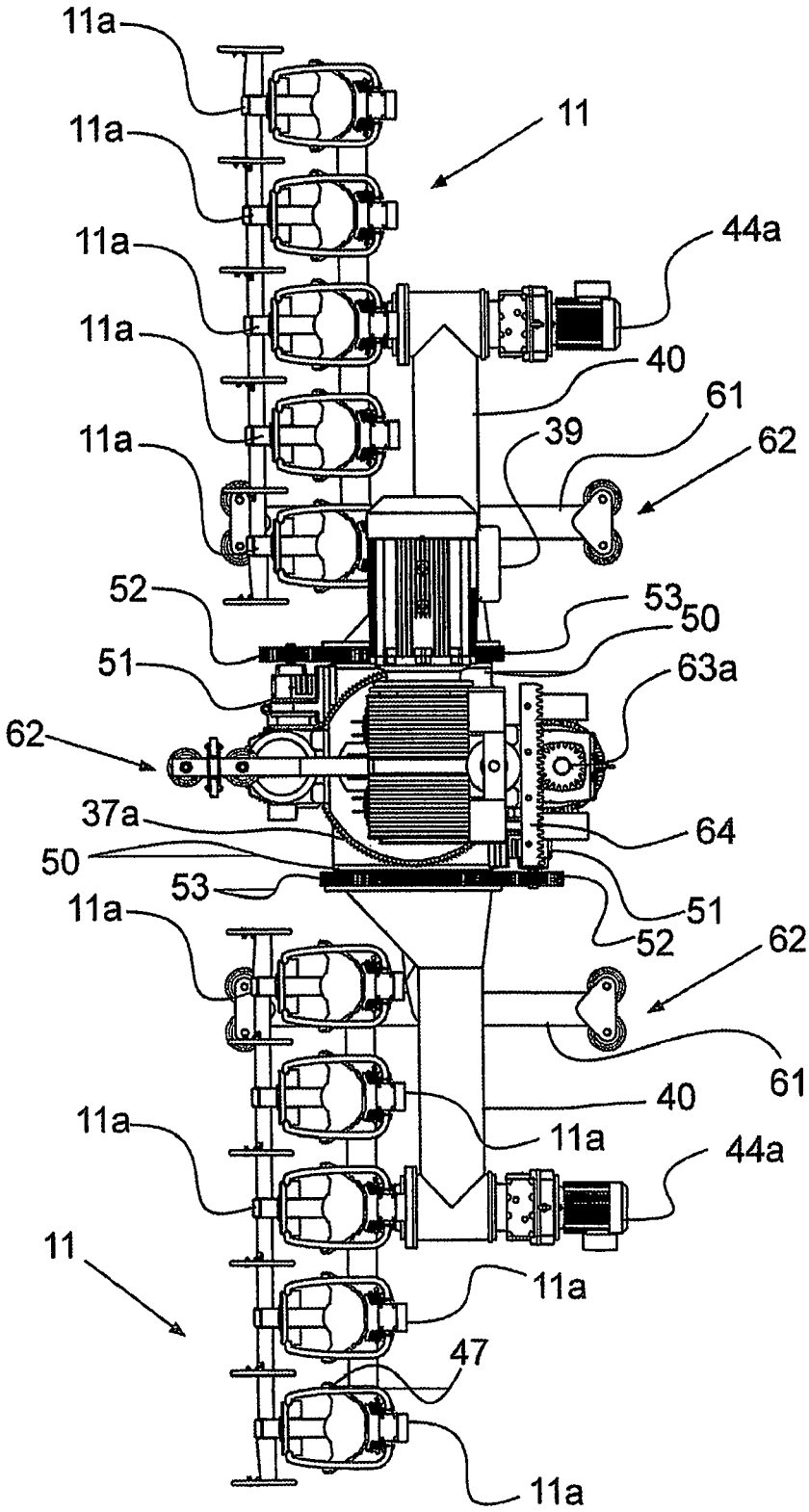

FIG. 9*b* a top view of the carriage of FIGS. 8*a,b,*

Figure 10:
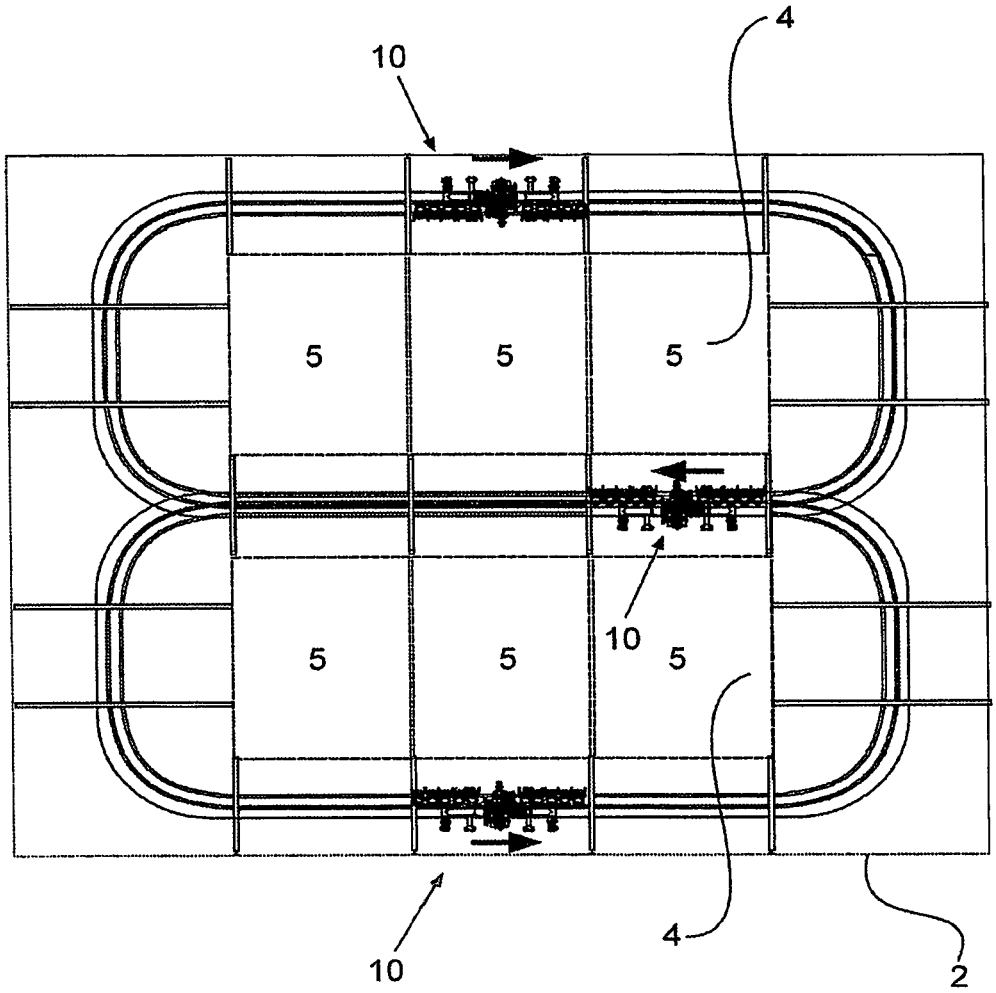
Figure 11:
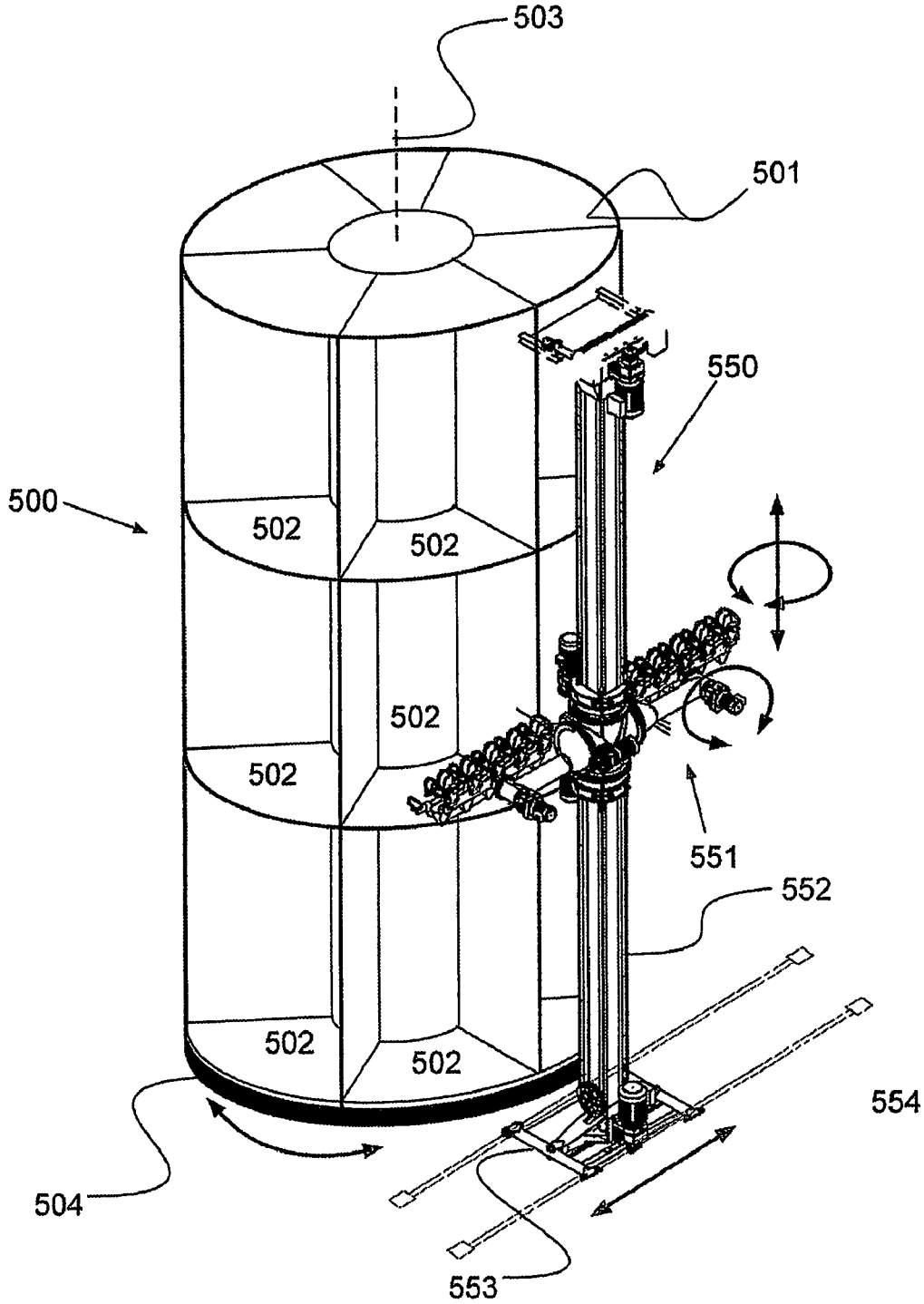

FIG. 10 a plan view of an alternative amusement park attraction according to the invention, and FIG. 11 a perspective view of yet another amusement park attraction according to the present invention.

In FIG. 1 an amusement park attraction 1 is shown according to the invention. The attraction 1 comprises an outer darkening building of which in FIG. 1 the contours are depicted by dashed lines. The building 2 has a roof 3.

Within the building 2 a structure 4 is arranged. The structure 4 comprises on the second and third floor an array of approximately equally sized and equally shaped rectangular cells 5. Adjacent cells 5 are separated from each other by boundaries, here as vertical separating walls or curtains 6. The outer cells, i.e. the cells 5 in the figure on the left most and right most side, are on the outer side delimited by side walls 7. The shaded parts in the front view of FIG. 1 illustrate a wall 8 that closes at the front side the cells 5 at the third floor on the right and on the second floor on the left. These cells 5 have an opening on the rear side of the structure 4. The other cells 5 are open on the front side and closed by a rear wall 9 on the rear side of the structure 4. Thus, in the embodiment of the structure 4 shown in FIG. 1, cells are defined by a boundary comprising walls, which boundary has an opening to the outside on the front side or the rear side.

In the embodiment of FIG. 1 the bottom floor of the structure 4 is formed as one chamber, but this floor can also be divided in separate cells as is shown in FIGS. 2*a* and 2*b*.

Within the building 2 one or more transport carriages 10 are arranged. The carriage 10 comprises a seat assembly 11 with one or more seats for the public. In the embodiment of FIGS. 1 and 2 the carriage 10 also comprises an upright 12 that can be moved around the structure 4 along path which preferably comprises a guiding track 13*a* that is arranged under the roof, and preferably also a guiding track 13*b* on the floor of the building 2. The seat assembly 11 of the carriage 10 can be moved in a vertical direction along the upright 12. By horizontal movement along the tracks 13*a*, 13*b* and vertical movement of the seat assembly 11 along the upright 12 every cell can be reached by the carriage 10. In this way it is possible to allow the persons in the carriage 10 to look into each cell 5.

The amusement park attraction can be designed to present a story to the passengers, the story containing a number of discrete scenes as well as motive effects to be experienced by the passengers.

The story might be such that not all available cells are needed to display scenes. In that case some cells will be left empty and if desired their viewing opening could be blocked.

If the park operator desires to present another story to the public a new story can be drafted and discrete scenes designed as well as motive effects experienced while passengers are viewing a scene as well as while being transported from one scene to the next (or from and to a boarding station). The scene relating to the existing story can then be removed from the array of cells and new scene placed in allocated cells. In its possible that the old story is moved to another park having a similar array of cells.

In a very special design of the amusement parc attraction of the present invention a story to be present by the attraction can have multiple versions. It is possible to provide multiple versions merely by providing specific versions of the motive effects experienced by the passengers, e.g. a more spectacular version for teenagers and a more subtle version for small children and/or elderly passengers. Also it is possible that the array of cells of the attraction contains one or more scene containing cells associated with a specific version while other cells are specifically designed for one or more other versions of the story. Of course two versions of a story can have scenes in common as well. In an extreme variant the array of cells contains two completely different stories, e.g. about unrelated themes. Then the actuating system is designed to provide a specific route for each version of the story of each distinct story, as well as to provide the related motive effects.

The transport carriage 10 is programmed such that the seats are moved along the viewing openings of scene containing cells 5 along a pretermined route and while effecting predetermined motive effects. The detailed functioning of the depicted carriage assembly 10 will be described further below, but it has to be understood that also another type of carriage assembly can be used which is suitable for moving along the cells 5 according to the programmable sequence and with a the desired motive effects.

In FIGS. 2*a* and 2*b* an arrangement according to the invention is shown wherein the outer building 2 comprises a frame comprising beams and tension elements that can be covered by cover plates to form the walls and ceiling of the building 2. For clarity reasons the cover plates have been omitted in FIG. 2*a* and the frame and cover plates have both been omitted in FIG. 2*b*. It is possible that a part of the cover plates of the building 2 is made of glass such that a sort of window is created. The seat assembly 11 at the window can be oriented such that the passengers can look out of the building 2 through the glass. Advantageously the public outside the building 2 can see the carriage 10 moving in a spectacular way through the window, e.g. during free-fall or upward launch, such that their attention is drawn to the attraction 1. In the embodiment shown in FIG. 2*a* the window could be arranged at the right side in the figure.

Within the building 2 a structure 4 as described before is arranged. The structure 4 comprises an array of cells 5, which have an opening at the front side or at the rear side. In this case in the upper row the middle cell 5 is closed at the front side and open at the rear side. On the middle row the most left cell 5 is closed at the front side and open at the rear side and the bottom row has the middle and the most right cell 5 closed at the front side and open at the rear side. The other five cells 5 are closed at the rear side and open at the front side. The side walls 7 of the cells 5 form a closed side surface of the structure 4, as is best seen in FIGS. 2*a* and 2*b*.

Preferably, multiple carriage assemblies 10 can travel across the track 13*a*, 13*b* at the same time as is illustrated by way of example in FIG. 7. Each carriage 10 is controllable by a control unit (not shown), whereby each carriage 10 can be controlled independently from other carriages 10. In a possible embodiment a central control unit can control the movements of all carriages 10. In another possible embodiment the carriages 10 each have their own control unit. Each carriage 10 follows its own program such that their seat assemblies 11 are directed to the cells 5 according to a predetermined sequence. Optionally, along the path that the carriages 10 follow, actuating means can be provided which can be detected by a sensor on the carriage 10 and which inform the control unit where the specific carriage 10 is and which can for example form the incentive to initiate a certain movement of the seat assembly 11. Also other position detection means can be used.

The building 2 preferably comprises a storage area 14 in which multiple carriage assemblies 10 can be stored. This storage feature provides the advantage that the number of carriages 10 on the track, i.e. the capacity of the attraction can be adapted to the number of passengers. If it is less crowded the number of carriages 10 necessary is less such that some of them can be stored, which advantageously provides a more economic use. The use of only the necessary number of carriages 10 furthermore decreases wear of parts, which is advantageous, and also saves power. By adding carriages 10 when the number of people waiting for the attraction increases, the waiting time can be kept at a desired length.

In the shown embodiment next to the storage area 14 is provided a boarding platform 15 where the passengers can get in the seats of the carriage. The boarding platform could be at any height, possibly at the top level of the attraction so that passenger.

Within selected cells 5 (animated) scenes are set up according to the story to be presented and the motive effects to be experienced. Each cell can function as a sort of show box. The public in the carriage 10 is transported so to say from show box to show box in a predetermined sequence that is determined by the story of the attraction. The cell arrangement as described allows the public only to see one scene at a time.

The scenes can be animated by use of animated objects like animated puppets, animated vehicles or other objects. Also can be applied optical means for projection of optical visual projections. The projections could be made on a glass surface placed within the cell 5 or in any other suitable way. It is possible to place a transparent surface in the viewing opening of a cell and project an image thereon, e.g. suddenly, so that passenger who were not aware of the presence of the transparent surface experience a surprise and shock effect in this manner.

A shutter could be provided for a viewing opening, e.g. an actuatable shutter which only opens as it is desired that the passengers see the scene in a cell. The shutter could be a curtain, blind, door, etc.

The carriage 10 is moveable in connection with the scene in a particular cell 5. This creates a perception with the public that they are indeed a part of the scene and the story it tells. One can think of e.g. a rocking movement of the seat assembly 11 of the carriage 10 when a sea is visible in the scene and the carriage 10 is simulating a boat. To make the illusion of reality stronger other means can be used. This can be blower means to blow air towards the persons in the carriage 10 to create the illusion of wind or an explosion. Additives like moist or a smell can be added to the air so as to create a wet sensation or certain smell that is connected to the story of the scene. For example a smell of smoke can be added when a fire is depicted in the scene, or a smell of gunpowder when a gunfight or an explosion is simulated. Of course also other means like visual and auditive means can be used to make a scene more real to the public.

The array of cells where cells are stacked upon one another has the advantage that the possibility is created to let the carriage 10 move in a vertical direction along the structure 4 with a highly accelerated or decelerated movement. In other words, the height of the structure 4 creates the possibility to make such accelerated movements, such as a free fall or a slightly decelerated free fall. Also a launch upwards can be simulated in this way. This accelerated or decelerated movement can be used to transport the seat assembly 11 from one cell 5 to another in connection with the story that is told by the scene(s) concerned. For example, it is possible that in the upper left cell of the structure 4 in FIGS. 2*a* and 2*b* a scene is set-up where a person (a puppet) cuts a cord of an elevator or the like. The public in the seat assembly 11 is given the illusion that they are within the elevator by moving the seat assembly 11 downwards to the left lower cell 5 in a free fall, where the following scene can be viewed. Preferably the seat assembly 11 is also able to perform rotation on movements in all directions such that frightening moments can be created by combination of fast translational and rotational movement. It must be understood that next to of high speed movement of the seat assembly 11, of course also slow movements are possible. The carriage assembly 10 will be described in more detail below.

In an alternative embodiment shown in FIG. 10 a building 2 is shown from above in which two structures 4 with cells 5 are arranged behind each other. Around the structures 4 is provided a track 13 substantially formed as an "8". Over the track 13 carriages 10 can move along and between the structures. Of course it is also possible to have more than two structures 4 which can be placed within a building 2 in any suitable manner.

Once again it is stressed that the array of cells does not necessarily have to be built like the shown structures 4 with adjacent cells 5. The array of cells can be arranged in any suitable or desired way, wherein cells are placed on different height levels.

FIGS. 3*a* and 3*b* show a schematic view of a carriage 20 according to the invention. In this embodiment the carriage 20 comprises a single vertical extending upright 22, movable along a track 21. In this embodiment, wheels 23 are connected to the frame 22 to guide movement of the frame 22 over the track 21. The frame 22 is designed as a vertical column with a square cross section. It comprises a framework of interconnected beams. One seat 24 is connected to the frame 22. This is shown in an enlarged view in FIG. 3*b*. A vertical guide rail 25 is arranged on the frame 22. A clamp 26 is connected to the seat 24 and can be translated vertically with respect to the frame 22, to which it is connected.

In FIGS. 4 and 5 a preferred embodiment of the carriage 10 of FIG. 2 is shown, respectively in a front view and a side view.

A vertical extending upright 12 is designed as an elongate hollow member with a rectangular cross section and with a central axis 12*a*.

Preferably the upright 12 has such a length that seat assemblies 11 for the passengers are movable in vertical direction at least 3 meters, more preferably 6 meters, more preferably at least 10 meters. The length of the upright 12 in this design is about 15 meters, but greater lengths of 25 meters or even up to 50 meters are possible as well.

The upright 12 is preferably made out of steel plates.

The bottom part 14 and upper part 18 of the upright 2 are movable along a track. At the bottom part 14, the underground or floor is indicated with 14*a*. On the underground 14*a* the rail 13*b* is arranged, in this embodiment with the shape of an I-profile. Load bearing wheels 14*c* travel over the rails. Guide wheels 14*d* support the upright on the sides of the rail 14*b*. A base part 14*e* forms a base for the upright 12 to which the wheels 14*c* and 14*d* are connected. Also, a winch and pulley support 14*f* is provided around the upright 12, connected to the base part 14*e*. At the upper part 18, the ceiling is indicated with 3. On the ceiling 3 the rail 13*a* is provided, in this embodiment with the shape of an I-profile. A trolley 18*a* is connected to the upright 12, to which a top wheel 18*b* is connected, travelling over the rail 13*a*, and guide wheels 18*c*. The trolley 18*a* is connected with a pulley support 18*d*.

In this example two seat assemblies 11 are arranged at opposite sides of the upright 12. A seat assembly 11 comprises a multiple seats 11*a*, in the shown example five seats 11*a*. The seats 11*a* are arranged in a row, and are all oriented in the same direction, such that all passengers 46 seated in the seats 11*a* of an assembly face in the same direction.

For each seat 11*a* a passenger restraining means 47 is provided in order to ensure that the passenger remains in the seat 11*a*. In this example FIG. 5 shows a (padded) over-the-shoulder restraining device 47 in its opened and restraining position. In other embodiments the restraining means could have a seat belt, harness, restraining bracket across the lap of the passenger(s), or other suitable means.

The seat assemblies 11 are connected to a hollow annular slide 36, which is arranged coaxial around the upright 12.

The slide 36 is movable along the upright 12 along and guided by guide rails 35 fitted on the upright 12, here two guide rails 35 at diametrically opposite locations. Sets of guide rollers 50 are connected to the slide 36 to slide along these guide rails 35.

The vertical motion of the slide 36 is effected by an programmable actuating system, which allows to program the vertical motions of the slide 36 independent from the horizontal motion of the carriage 10.

A programmable electronic control system 48 is arranged on the carriage 10 to control the vertical motion of the slide 36 as well as any other motion(s) performed by each passenger assembly 11 on the carriage 10. If the carriage 10 also has its own drive means for effecting the movement in horizontal direction, it is preferred that this motion is controlled by the system 48 as well.

This control system 48 here includes a programmable electronic control device, such as a Programmable logic controller (PLC) or a computer. As each carriage has its own programmable control device the operation is highly reliable. Of course the attraction can have a central control system as well, e.g. for avoiding collision between carriages. This central control system could communicate in a wireless manner with the control system 48 on each carriage 10.

In this example the actuating system for effecting the vertical motion of the slide 36 includes a winch 39, here driven by suitable electronic drive motor assembly 39*a* allowing a controlled speed variation, a wire 38 connected to the winch 39 and the slide 36.

Here the winch assembly 39 is situated at the lower part of the carriage 10 and supported by a winch support 14*f*.

Here the wire 38 extends between two pulleys 40, the upper pulley 400*a* connected to the pulley support 18*d* and the lower pulley 400*b* connected to the winch support 14*f*. The winch assembly 39 allows to move the wire 38 in two directions in order to move the slide 36 upwards or downwards in a controlled manner.

Possibly the winch drive motor assembly 39*a* includes an electric motor having electronic control means for controlled variation of the winch speed.

Electrical power is fed to the carriage 10 and the motor(s) and electronic control means thereon preferably via a electric power rail extending along the track and an associated power take-off assembly.

Preferably the winch assembly 39 is adapted to effect significant accelerations and/or decelerations in vertical direction of the slide 36 in upwards and/or in downward direction. Preferably accelerations and/or decelerations of at least 0.15 G, more preferably at least 0.3 G, more preferably at least 0.7 G can be effected by a suitable design of the winch assembly 39 or other actuating system parts.

For the downward motion an acceleration of about 1 G is preferred to effect a free-fall experience. For the upward motion lower accelerations are envisaged, mainly due to limitations on the actuating system (e.g. the supply of electrical power).

This is done e.g. to be able to simulate a free-fall by rapidly moving the slide downwards or an upward launch.

In a possible embodiment a hydraulic linear actuator is provided, which actuator moves one or more pulleys along which wire 38 is passed. This actuator could be valved communication with an accumulator for storing pressurised hydraulic fluid, so that energy can be stored in this accumulator and upon opening the valve a rapid motion of the actuator is caused, resulting in a rapid motion of the slide. Such an actuator could be added to a winch assembly.

Coaxial around the slide 36 a hollow annular socket 37 is arranged. This socket 37 is rotatable with respect to the slide 36 about a vertical axis, and thus with respect to the upright 12. The seat assemblies 11 are connected to the socket 37, and thus a rotational movement of the socket 37 corresponds to a rotational movement of the seat assemblies 11. The rotation axis of this rotation coincides with the central axis 12*a* of the upright 12. The rotational range could be a full 360 degrees but more limited rotation ranges, e.g. of 180 degrees or even less are also possible.

The socket 37 is rotatable by rotation drive means 41, here arranged between the slide 36 and the socket 37. These drive means 41 could include an electric motor with a gear transmission, preferably having a variable speed control for the electric motor. Other designs, such as including a hydraulic actuator are also possible. The control of the drive means 41 is preferably effected by the system 48. Bearings are preferably provided between the slide 36 and the socket 37, such as rollers and corresponding roller guides.

The seat assembly 11 is connected to the socket 37 by means of an arm 40, extending sideways, e.g. radially, from the upright 12. The arm 40 has a free end, which in the example shown is about in the central area of a seat assembly 11.

This arm 40 can, according to various embodiments, be divided into various sections by one or multiple hinges or pivot structures.

Possible hinges are schematically depicted in FIGS. 6*a*-6*e*. A frame is numbered 102, without a slide or a socket. Of course, a slide and/or a socket could be provided. A seat assembly is indicated schematically and numbered 104. An arm is indicated as a whole with the number 105, connecting the seat assembly 104 to the frame 102. The seat assembly 104 is shown in straight lines in a first position, and in dotted lines in a second position when rotated around A hinge.

FIG. 6*a* shows a first hinge 111 with a vertical hinge axis 111', located close to the frame 102, dividing the arm 105 into an inner arm part 105*b* connected to the frame 102 and an outer arm part 105*a* connected to the seat assembly 104. The outer arm part 105*a* can rotate with the seat assembly 104 around the hinge axis 111' to a second position, for example the position indicated in dotted lines.

FIG. 6*b* shows another first hinge 112 located at the end of the arm 105 close to the seat assembly 104, at the central area of the seat assembly 104. The seat assembly 104 can rotate around hinge axis 112', while the arm 105 is connected to the frame 102.

With combination of a hinge 111 according to FIG. 6*a* and a hinge 112 of FIG. 6*b* a forward and backward horizontal movement of the seat assembly is possible wherein the seat assembly remains oriented in the same direction, e.g. parallel to the structure 4 in FIGS. 1 and 2. However, as a consequence of the rotation around hinge axis 111' there is always a horizontal movement sideways of the seat assembly. A pure forward or backward horizontal movement of the seat assembly could also be achieved with a slide which extends rectangular with respect to the arm.

FIG. 6*c* shows a second hinge 113 with a horizontal hinge axis 113' extending radially from the frame 102. The hinge 113 divides the arm 105 into an inner arm section 105*c*, connected to the frame 102 and an outer arm section 105*d*, connected to the seat assembly 104. The outer arm section 105*d* rotates with the seat assembly 104 around the rotation axis 113', e.g. bringing the seat assembly 104 to a second position indicated in dotted lines.

In FIG. 6*d* a third hinge 114 is shown, with a hinge axis 114' perpendicular to the frame 102 and to the arm 105, and hence perpendicular to the plane of the drawing. The hinge 114 is located at the end of arm 105 under the central area of the seat assembly 104. Hence, this hinge allows movement of the seat assembly only, with the arm 105 connected to the frame 102. The seat assembly 104 can move clockwise and anticlockwise in the plane of the drawing. A small clockwise rotation is indicated in dotted lines.

FIG. 6*e* shows another third hinge 115, with a hinge axis 115' perpendicular to the frame 102 and to the arm 105, and hence perpendicular to the plane of the drawing. The third hinge 115 is located close to the frame 102 and divides arm 105 in two parts 105*e* and 105*f*. Part 105*e* of the arm is connected to the frame, and part 105*f* is connected to the seat assembly 104. Part 105*f* rotates with the seat assembly 104 around the hinge axis 115'.

In the preferred embodiment shown in FIGS. 4 and 5 various hinges are visible. A second hinge 43 with hinge axis 43' is visible on the arm 40 under the seat assembly 11. This second hinge 43 operates in a similar way to hinge 113 depicted in FIG. 6*c*. The hinge 43 divides arm 40 into an inner arm part 40*a* connected to the frame 12 and an outer arm part 40*b* connected to the seat assembly 11 and rotating with the seat assembly 11 around the hinge axis 43'. A third hinge 44 is located under the central area of the seat assembly 11, allowing a rotation of the seat assembly 11 around the hinge axis of this third hinge 44. The operation of this third hinge 44 is similar to the hinge 114 schematically depicted in FIG. 6*d*.

Figure 8B:
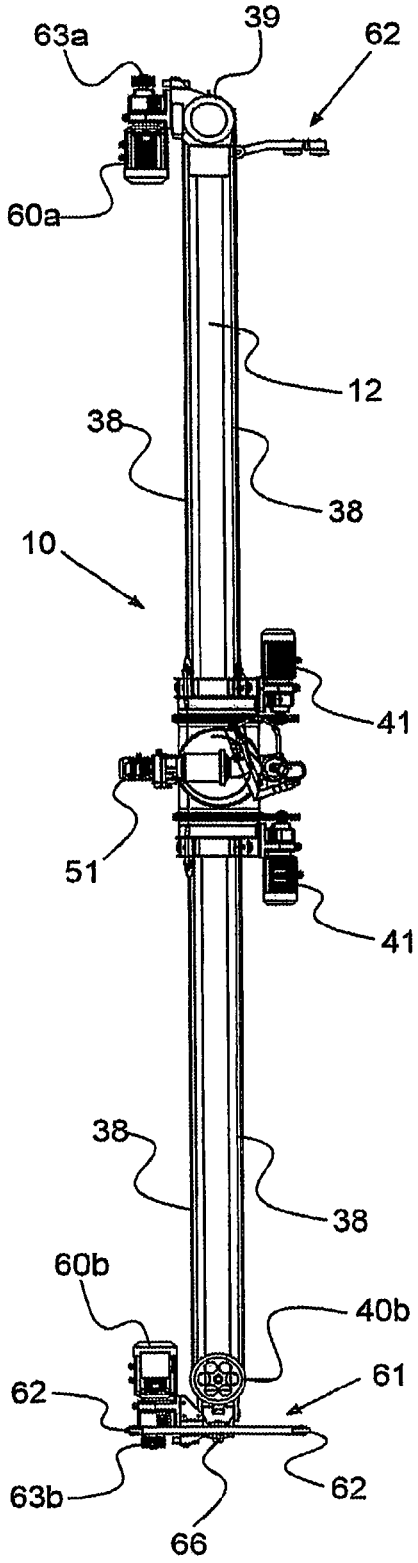

FIGS. 8*a* and 8*b* another preferred embodiment of the carriage 10 of which in FIGS. 9*a* and 9*b* a detail is shown. The upright 12 is at the lower and upper end provided with drive means 60*a* and 60*b* respectively for driving the upright 12 along the upper and lower rail structure (not shown in these figures). Preferably these drive means include an electric motor, preferably having variable speed control.

The drive means 60*a* and 60*b* here each have a gear wheel 63*a* and 63*b* respectively mounted at their drive axis. The gear wheels 63*a* and 63*b* together with a rack 64 (see FIG. 9*b*) to form a rack and pinion assembly.

At the lower end of the upright one or more load bearing support rollers 66 are provided. At the lower end of the carriage side arms 61 having guide wheels 62 are also provided. Also guide wheels 62 are provided at the upper end of the upright. The rollers 66 and guide wheels 62 cooperate with suitable rails to support the upright through the building 12 and provide stability to the carriage 10.

The upright 12 is embodied here as a welded tubular upright having a polygonal cross-section, in this example a rectangular or square cross-section. Other sections, such as octagonal are also possible. The upright is construed by welding together steel plates.

The seat assemblies 11 each comprises a row of seats 11*a* on a common subframe. On the upright 12 a slide 36 is arranged. The slide 36 has guiding wheels or other bearing means 36*a*, which guide the slide 36 along the upright 12. It is envisaged that the upright 12 has contact surfaces for the guiding wheels 36*a*. Preferably these contact surfaces have been milled in order to remove weld materials and other unevenness. It is envisaged that an entire upright is positioned in a large milling apparatus in order to obtain highly accurate contact surfaces for the guiding wheels or other suitable bearing members.

A hoisting device moves up and down the slide 36, comprising hoisting wires 38, a winch assembly 39 and a pulley 400*b*.

The winch assembly includes a drum and suitable motor(s). Possibly the winch motor is an electric motor having speed control means for controlled variation of the winch speed.

Both the hoisting device and the drive means 60*a*, 60*b* are connected to a control system 48 arranged on the carriage, which control system contains a programmable control device, such as a PLC or computer. As each carriage has its own programmable control device the operation is highly reliable. Of course the attraction can have a central control system as well, e.g. for avoiding collision between carriages. This central control system could communicate in a wireless manner with each carriage.

Coaxial around the slide 36 a hollow cylindrical socket 37 is arranged. The socket 37 is rotatable around the slide 36 by rotation drive means 41. Said rotation drive means 41 comprise e.g. one or more electric motors with a gear wheel 41*a* on its drive axis. The socket 37 is provided with a ring shaped gear element 37*a*, which is arranged around the circumference of the socket. The outwardly directed teeth of the gear element 37*a* mesh with the teeth of the gear wheel 41*a*.

Each seat assembly 11 is connected to the socket 37 by means of an arm 40. Each arm 40 can be rotated around a hinge 50, which in this embodiment is located at the socket 37. The rotation around the hinge 50 is drivable by drive means comprising e.g. an electric motor 51 with a gear wheel 52 on its drive axis. The arm 40 is provided at its inner end provided with a ring shaped gear element 53 arranged around its circumference. The outwardly directed teeth of the gear element 53 mesh with the teeth of the gear wheel 52 such that the arm 40 can be rotated around the hinge axis of hinge 50 by the motor.

At the outer end of the arm a hinge 44 is located which rotatably connects the middle part of the seat assembly 11 with the arm 40. The seat assembly 11 can be rotated around the hinge axis of this hinge 44 by drive means 44*a*, e.g. an electric motor, which is arranged at the end of the arm 40 as well.

It must be well understood that the carriage according to the invention is not only suitable for an amusement park attraction as is described with reference to FIGS. 1 and 2. The carriage is also applicable in other amusement rides. It is noted that the carriage as described above has six degrees of freedom, which is useful in spectacular rides. It is however possible to remove some of the movement options by omitting some hinges and associated driving means. For instance the carriage could be designed for a amusement ride for children where not all the rotative motions are desired. Also it is foreseeable that a ride with lower velocities is used in applications like a ride for children.

In FIG. 11 an alternative amusement park attraction 500 is shown. In this attraction 500 a structure 501 provides a circular (or annular) matrix of cells 502, here in a multi-story arrangement, so that cells 502 are arranged at various horizontal positions and various vertical positions.

The entire array of cells supporting structure 501 is mounted movable, in this example rotatable about a vertical axis 503. For example a foundation 504 is provided with one or more rails on which trolleys run. Not shown is an actuating device for controlled rotation of the structure 501.

The cells 502 here have their viewing openings towards the outside of the structure 501. As mentioned before a "story" will require some (possible all) of the cells to contain a scene.

At a position along the outside of the structure 501 a motion apparatus 550 is located. In a variant more than one motion apparatus 550 are provided at different locations along the path of the viewing openings of the cells 502.

This motion apparatus 550 includes a movable passenger assemblies 551, in this example including two rows of seat similar to the embodiment of FIGS. 8*a,b*. The apparatus 550 also includes an upright 552 or other vertical extending frame, such that the seat assemblies 551 are moveable along the height of the structure 501.

The motion apparatus 550 could be positioned in a fixed location. In this example the upright is part of a carriage 553 which is movable over a limited horizontal track 554. This allows to cause a horizontal motion experience for the passenger. A limited horizontal mobility could also be used to move the seat assemblies to a boarding station (not shown).

By suitable programming the motion apparatus 550 a programmed route of said passenger assembly 551 along the viewing openings of said scene containing cells is provided, so that the one or more passengers are presented a predetermined sequence of scenes and at least experience a vertical motion along said route.

The motion apparatus 550 could have all the options discussed before with reference to the carriages.

The present invention also envisages to provide the motion apparatus and/or carriage disclosed herein in an embodiment without cells containing discrete scenes, but rather in a continuous scenery. Also it can be envisaged to design the motion apparatus entirely without associated specially designed scenery, but arranged it in a attraction park, e.g. in open air, preferably at a fixed location but possibly movable in horizontal direction along a path.

The invention claimed is:

1. Amusement park attraction comprising:

a carriage movable along an associated carriage path, said carriage comprising:

a vertical extending frame, wherein the vertical extending frame, as part of the carriage, is movable along the associated carriage path, at least one passenger assembly, for one or more passengers, wherein said passenger assembly comprises a restraining device for the passengers, adapted to restrain each individual passenger, wherein said passenger assembly is guided by said frame and movable in a vertical translational movement with respect to the frame, an array of cells in a matrix arrangement of cells next to one another and above one another, the array including cells being arranged at various horizontal positions along said carriage path and various vertical positions with respect to said carriage path, wherein a cell is defined by a boundary and has a viewing opening, the boundaries separating adjacent cells from each other, and wherein multiple cells of said array each contain a discrete scene to be viewed by the one or more passengers, a programmable actuating system, which actuating system provides a programmed route of said carriage and of said passenger assembly along the viewing openings of said scene containing cells, to allow the passengers in the carriage to look into the cell so that the one or more passengers are presented a predetermined sequence of scenes and at least experience a vertical motion and a horizontal motion along said route, wherein the actuating system can move the passengers from one discrete scene to an adjacent discrete scene at a different horizontal position by moving the vertical extending frame along the associated carriage path, and from one discrete scene to an adjacent discrete scene at a different vertical position by moving the passenger assembly along the vertical extending frame.

2. Amusement park attraction according to claim 1, wherein the passenger assembly is movable in vertical direction and at least in one other direction, said other directions including at least one rotational direction.

3. Amusement park attraction according to claim 1, wherein said array of cells is stationary and the actuating system is associated with said carriage and said passenger assembly to impart motions at least in vertical as well as horizontal direction to said passenger assembly.

4. Amusement park attraction according to claim 1, wherein the carriage path extends essentially in a horizontal plane, and wherein the array includes cells being arranged at various horizontal positions along said carriage path including cells being arranged at various vertical positions with respect to said carriage path, and wherein the passenger assembly is movable in at least vertical direction with respect to the frame.

5. Amusement park attraction according to claim 1, wherein the carriage path is formed by a track.

6. Amusement park attraction according to claim 5, wherein the track comprises an upper and a lower rail along which an upper and a lower end of the carriage are respectively guided.

7. Amusement park attraction according to claim 1, wherein a storage facility is provided for storing at least one carriage remote from the carriage path while said carriage is not in use.

8. Amusement park attraction according to claim 1, wherein the array of cells comprises a matrix arrangement of cells next to one another and above one another.

9. Amusement park attraction according to claim 8, wherein said matrix arrangement of cells is embodied as an essentially flat faced block of cells having viewing openings at one side or both side of the block of cells.

10. Amusement park attraction according to claim 8, wherein said matrix arrangement of cells is embodied as an at least partly curved faced block of cells, possibly a circular or annular block of cells, having viewing openings at one or both sides of the block of cells.

11. Amusement park attraction according to claim 1, wherein the passenger assembly is movable at least 3 meters in vertical direction.

12. Amusement park attraction according to claim 1, wherein the actuating system is adapted to provide an acceleration and/or deceleration of the passenger assembly in vertical direction, in downwards and/or upwards direction, of at least 0.15 G.

13. Amusement park attraction according to claim 1, wherein the actuating system is adapted to provide an acceleration and/or deceleration of the passenger assembly in vertical direction, in downwards and/or upwards direction, of at least 0.3 G to simulate or provide a free-fall experience and/or upwards launch movement.

14. Amusement park attraction according to claim 1, wherein the passenger assembly is adapted for rotation of the one or more passengers between a "head-up" and a "head-down" orientation.

15. Amusement park attraction according to claim 1, wherein the viewing openings of the cells are arranged such that the view of the passengers is limited to one scene at a time.

16. Amusement park attraction according to claim 1, wherein one or more scenes comprise one or more animated physical objects, selected from the group of puppets (human, animal), vehicles (cars, trains), boats, aircraft, space craft, machinery, natural phenomena (vulcano).

17. Amusement park attraction according to claim 1, wherein one or more scenes comprise projected images.

18. Amusement park attraction according to claim 1, wherein the actuating system is adapted to move the passenger assembly in co-ordination with an animation effect provided by a scene, so as to add a motive sensation to the passengers viewing the scene.

19. Amusement park attraction according to claim 1, wherein one or more cells have air blow means for providing special effects related to the scene in the cells concerned.

20. Amusement park attraction according to claim 1, wherein the array of cells is formed as a structure with a ceiling, floor, side walls and a rear wall for each cell, the front forming the viewing opening of the cell.

21. Amusement park attraction according to claim 1, wherein multiple cells of the array have the same dimensions.

22. Amusement park attraction according to claim 1, wherein one or more of the cells have different dimensions as the other cells.

23. Amusement park attraction according to claim 1, comprising an outer darkening structure enclosing the array of cells and the at least one passenger assembly.

24. Amusement park attraction according to claim 23, wherein the outer darkening structure has an outer surface with at least one transparent portion where through a part of the inside of the attraction is visible for public outside the outer darkening structure, such that the route of the passenger assembly passes along said transparent portion.

25. Amusement park attraction according to claim 1, in which said frame allows for a vertical motion of said passenger assembly of at least 10 meters.

26. Amusement park attraction according to claim 1, wherein the frame has a single vertical upright along which the passenger assembly is guided in vertical direction.

27. Amusement park attraction according to claim 1, further comprising a slide, to which the passenger assembly is connected and which slide is movable along the frame.

28. Amusement park attraction according to claim 27, in which the slide is arranged coaxial with the frame.

29. Amusement park attraction according to claim 1, in which the frame is provided with one or more guide rails along which the passenger assembly is guided.

30. Amusement park attraction according to claim 1, furthermore provided with a hoisting device for moving the passenger assembly in vertical direction.

31. Amusement park attraction according to claim 30, in which said hoisting device comprises at least one hoisting wire, a winch assembly and one or more pulleys guiding the hoisting wire.

32. Amusement park attraction according to claim 1, further provided with rotation drive means so as to allow a rotational movement of the passenger assembly with respect to the frame around a rotation axis extending parallel to the vertical axis of the frame.

33. Amusement park attraction according to claim 27, wherein the slide is arranged rotatably with respect to the frame.

34. Amusement park attraction according to claim 27, wherein a socket is connected to the slide, the socket being rotatable with respect to the slide.

35. Amusement park attraction according to claim 34, wherein the socket is arranged coaxial with the slide.

36. Amusement park attraction according to claim 34, in which rotation drive means are arranged between the slide and the socket so as to allow a rotational movement of the socket with respect to the slide.

37. Amusement park attraction according to claim 1, comprising an arm which extends radially from the frame and bears the passenger assembly.

38. Amusement park attraction according to claim 37, in which the arm comprises one or more hinges.

39. Amusement park attraction according to claim 38, comprising a first hinge with a substantially vertical hinge axis so as to allow a rotational movement of the passenger assembly in a horizontal plane.

40. Amusement park attraction according to claim 39, in which the first hinge is located at an end of the arm close to the frame.

41. Amusement park attraction according to claim 39, in which the first hinge is located at an end of the arm close to the seat assembly.

42. Amusement park attraction according to claim 38, comprising a second hinge with a substantially horizontal hinge axis which extends radially from the frame so as to allow a forward or backward tilting movement of the passenger assembly.

43. Amusement park attraction according to claim 38, comprising a third hinge with a hinge axis which extends in a horizontal direction perpendicular to the longitudinal axis of the arm and perpendicular to the longitudinal axis of the frame.

44. Amusement park attraction according to claim 43, in which the third hinge is located in a central area of the passenger assembly.

45. Amusement park attraction according to claim 1, in which the passenger assembly comprises one or more seats for the one or more passengers.

46. Amusement park attraction according to claim 45, in which the passenger assembly comprises at least one set of multiple seats which are arranged next to each other in a row.

47. A method for operating an amusement park attraction, the amusement park attraction comprising:

a carriage movable along an associated carriage path, said carriage comprising:

a vertical extending frame, wherein the vertical extending frame, as part of the carriage, is movable along the associated carriage path, at least one passenger assembly, for one or more passengers, wherein said passenger assembly comprises a restraining device for the passengers, adapted to restrain each individual passenger, wherein said passenger assembly is guided by said frame and movable in a vertical translational movement with respect to the frame, an array of cells in a matrix arrangement of cells next to one another and above one another, the array including cells being arranged at various horizontal positions along said carriage path and various vertical positions with respect to said carriage path, wherein a cell is defined by a boundary and has a viewing opening, the boundaries separating adjacent cells from each other, and wherein multiple cells of said array each contain a discrete scene to be viewed by the one or more passengers, a programmable actuating system, which actuating system provides a programmed route of said carriage and of said passenger assembly along the viewing openings of said scene containing cells, to allow the passengers in the carriage to look into the cell so that the one or more passengers are presented a predetermined sequence of scenes and at least experience a vertical motion and a horizontal motion along said route, wherein the actuating system can move the passengers from one discrete scene to an adjacent discrete scene at a different horizontal position by moving the vertical extending frame along the associated carriage path, and from one discrete scene to an adjacent discrete scene at a different vertical position by moving the passenger assembly along the vertical extending frame the method including the steps of:

drafting a story containing a sequence of discrete scenes, associating to one or more of said scenes motive effects to be experienced by the one or more passengers, allocating each of the discrete scenes to a suitable cell in the array of cells, programming the actuating system in order to effect the route along the scenes and any desired motive effect to be experienced by the one or more passengers.

48. Amusement park attraction comprising:

a carriage movable along an associated carriage path, said carriage comprising:

a vertical extending frame, wherein the vertical extending frame, as part of the carriage, is movable along the associated carriage path, at least one passenger assembly, for one or more passengers, wherein said passenger assembly comprises a restraining device for the passengers, adapted to restrain each individual passenger, wherein said passenger assembly is guided by said frame and movable in a vertical translational movement with respect to the frame, a structure comprising an array of cells, the array including cells being arranged at various horizontal positions and various vertical positions, wherein a cell is defined by a boundary and has a viewing opening, and wherein multiple cells of said array each contain a discrete scene to be viewed by the one or more passengers, wherein cells are provided with their viewing opening on the front side of the structure and cells are provided with their viewing opening on the rear side of the structure, and wherein the carriage path extends along both the front side of the structure and the back side of the structure such that the viewing opening of each cell can be reached by the carriage to allow the passengers in the carriage to look into the cell, and a programmable actuating system, which actuating system provides a programmed route of said carriage and of said passenger assembly along the viewing openings of said scene containing cells, to allow the passengers in the carriage to look into the cell so that the one or more passengers are presented a predetermined sequence of scenes and at least experience a vertical motion and a horizontal motion along said route, wherein the actuating system can move the passengers from one discrete scene to another discrete scene at a different horizontal position by moving the vertical extending frame along the associated carriage path, and from one discrete scene to another discrete scene at a different vertical position by moving the passenger assembly along the vertical extending frame.

49. Amusement park attraction according to claim 48, wherein the array of cells comprises a matrix arrangement of cells next to one another and above one another.

50. Amusement park attraction according to claim 49, wherein said matrix arrangement of cells is embodied as an essentially flat faced block of cells having viewing openings at both sides of the block of cells.

51. Amusement park attraction according to claim 49, wherein said matrix arrangement of cells is embodied as an at least partly curved faced block of cells, possibly a circular or annular block of cells, having viewing openings at both sides of the block of cells.

52. Amusement park attraction according to claim 48, further provided with rotation drive means so as to allow a rotational movement of the passenger assembly with respect to the frame around a rotation axis extending parallel to the vertical axis of the frame.

53. Amusement park attraction according to claim 48, comprising an arm which extends radially from the frame and bears the passenger assembly.

54. Amusement park attraction according to claim 53, in which the arm comprises one or more hinges.

55. Amusement park attraction comprising:

a carriage movable along an associated carriage path, said carriage comprising:

a vertical extending frame, wherein the vertical extending frame, as part of the carriage, is movable along the associated carriage path, two passenger assemblies, each for one or more passengers, wherein said passenger assembly comprises a restraining device for the passengers, adapted to restrain each individual passenger, wherein the frame has a single vertical upright along which said passenger assembly is guided in a vertical translational movement with respect to the frame, a lower guide track for guiding the lower end of the vertical extending frame along the carriage path and an upper guide track for guiding the upper end of the vertical extending frame along the carriage path, an array of cells, the array including cells being arranged at various horizontal positions along said carriage path and various vertical positions with respect to said carriage path, wherein a cell is defined by a boundary and has a viewing opening, and wherein multiple cells of said array each contain a discrete scene to be viewed by the one or more passengers, and a programmable actuating system, which actuating system provides a programmed route of said carriage and of said passenger assembly along the viewing openings of said scene containing cells, to allow the passengers in the carriage to look into the cell so that the one or more passengers are presented a predetermined sequence of scenes and at least experience a vertical motion and a horizontal motion along said route, wherein, the actuating system can move the passengers from one discrete scene to another discrete scene at a different horizontal position by moving the vertical extending frame along the associated carriage path, and from one discrete scene to another discrete scene at a different vertical position by moving the passenger assembly along the vertical extending frame.

56. Amusement park attraction according to claim 55, further comprising a slide, to which the passenger assembly is connected and which slide is movable along the frame.

57. Amusement park attraction according to claim 55, further provided with rotation drive means so as to allow a rotational movement of the passenger assembly with respect to the frame around a rotation axis extending parallel to the vertical axis of the frame.

58. Amusement park attraction according to claim 55, comprising an arm which extends radially from the frame and bears the passenger assembly.

59. Amusement park attraction according to claim 58, in which the arm comprises one or more hinges.

* * * * *